US006131083A

United States Patent [19]

Miseki et al.

[11] Patent Number: 6,131,083

[45] Date of Patent: Oct. 10, 2000

[54] METHOD OF ENCODING AND DECODING SPEECH USING MODIFIED LOGARITHMIC TRANSFORMATION WITH OFFSET OF LINE SPECTRAL FREQUENCY

[75] Inventors: Kimio Miseki; Katsumi Tsuchiya, both of Kobe, Japan

[73] Assignee: Kabushiki Kaisha Toshiba, Kawasaki, Japan

[21] Appl. No.: 09/219,773

[22] Filed: Dec. 23, 1998

[30] Foreign Application Priority Data

Dec. 24, 1997 [JP] Japan ..... 9-355749

[51] Int. Cl.[7] ..... G10L 19/04

[52] U.S. Cl. ..... 704/217; 704/219; 704/230; 704/222

[58] Field of Search ..... 704/201, 203, 704/216, 217, 218, 219, 220, 222, 230

[56] References Cited

U.S. PATENT DOCUMENTS

| | | | |
|---|---|---|---|
| 5,596,676 | 1/1997 | Swaminathan et al. | 704/208 |
| 5,651,026 | 7/1997 | Lin et al. | 375/240 |
| 5,675,701 | 10/1997 | Kleijn et al. | 704/222 |
| 5,751,903 | 5/1998 | Swaminathan et al. | 704/230 |
| 5,822,723 | 10/1998 | Kim et al. | 704/222 |
| 5,966,688 | 10/1999 | Nandkumar et al. | 704/222 |

FOREIGN PATENT DOCUMENTS 0 658 876 6/1995 European Pat. Off. .

OTHER PUBLICATIONS

Akimitsu Seki, et al., "The MEL LSP Vector Quantization Speech Coding Method", Shingakugiho, SP86–14, Jun. 1986, pp. 9–16.

Atsushi Mano, et al., "Pitch Synchronous MEL Inverse LSP Analysis–Synthesis Technique of LPC Voiced Residual", Shingakuron, A vol. J71–A, No. 3, Mar. 1988, pp. 634–641.

Shuuichi Arai, et al., "A LSP Analysis–Synthesis Method on MEL Frequence Scale Combined with Linear One", The Transactions of the IEICE, vol. E71, No. 7, Jul., 1988, pp. 648–653.

Sadaoki Furui, "Digital Audio Processing", Tokai University Press, 1985, pp. 60–65 and pp. 88–93.

R.P. Cohn, et al., IEEE International Conference on Acoustics, Speech, and Signal Processing (ICASSP), vol. 2, pp. 1347–1350, "Incorporating Perception into LSF Quantization Some Experiments," 1997.

R.P. Ramachandran, et al., IEEE Transactions on Speech and Audio Processing, vol. 3, No. 3, pp. 157–167, "A Two Codebook Format for Robust Quantization of Line Spectral Frequencies, " May 1, 1995.

K. Fellbaum, pp. 126–141, "Sprach Vararbeitung Und Sprachubertragung," 1984.

*Primary Examiner*—David R. Hudspeth
*Assistant Examiner*—Abul K. Azad
*Attorney, Agent, or Firm*—Oblon, Spivak, McClelland, Maier & Neustadt, P.C.

[57] ABSTRACT

On the basis of an autocorrelation coefficient calculated by an autocorrelation coefficient computation section from an input speech signal, an LSF computation section computes LSF parameters F(k) (k=1, 2, . . . , N). A modified logarithmic transformation section performs on the LSF parameters a logarithmic transformation with offset defined by f(k)= logC (1+A×F(k)) to obtain modified logarithmic LSF parameters f(k). The resulting modified logarithmic LSF parameters are quantized by a quantization section to provide quantized LSF parameters fq(k). Codes representing the quantized LSF parameters fq(k) are outputted. An inverse transformation defined by $Fq(k)=(C^{fq(k)}-1)/A$ is performed on the LSF parameters fq(k) to output LSF parameters Fq(k) on the general frequency scale.

16 Claims, 5 Drawing Sheets

METHOD OF ENCODING AND DECODING SPEECH USING MODIFIED LOGARITHMIC TRANSFORMATION WITH OFFSET OF LINE SPECTRAL FREQUENCY

BACKGROUND OF THE INVENTION

The present invention relates to an efficient encoding/decoding system for speech signals and more specifically to a method of encoding/decoding LSF (line spectral frequency) parameters which are a type of speech parameter and which represent spectral envelope information of an input speech signal.

The spectral envelope of an input speech signal can be represented by LPC (linear predictive coding) coefficients obtained by making an LPC analysis of the input speech signal using autocorrelation coefficients obtained from the input speech signal. For speech encoding, the LPC coefficients are transformed into line spectral frequency (LSF) parameters F(k) (k=1, 2, . . . , N), which are information equivalent to the LPC coefficients. The LSF parameters are also referred to as LSF parameters. The LSF parameters are ones on the frequency axis. When the input speech signal is sampled at 8 KHz by way of example, F(k) are known to take values in the range of 0 to 4,000 Hz.

In a conventional LSF encoder, the code of LSF parameters is selected from an LSF parameter codebook so that the error is minimized while LSF parameters F(k) obtained by subjecting an input speech signal to autocorrelation computation and LSF computation is used as a target and the weighted square error criterion is used as an indicator. The weights, which are computed in the weight computation section and used in the weighted vector quantizer, are set large for LSF parameters the distance between which on the frequency axis is small, and small for LSF parameters the distance between which is large. This is intended to attach importance to frequencies in the neighborhood of the peak of the spectral envelope. The weighted vector quantizer generates quantized LSF parameters and corresponding codes.

The coded LSF parameters are retransformed into LPC coefficients, thereby generating coded LPC coefficients. The coded LPC coefficients are used as parameters of a synthesis filter to represent the spectral envelope characteristic of input speech.

As can be seen from the foregoing, in the conventional technique, the perceptual sensitivity in respect to different perceptual frequencies is not reflected in coding of the LSF parameters. Thus, unless the coding distortion of the LSF parameters is reduced to a sufficiently low level, distortion becomes easy to be perceived at frequencies which is perceptually sensitive, resulting in a degradation in speech quality. For this reason, the conventional technique has a problem that the coding bit rate of the LSF parameters cannot be reduced much.

As another conventional technique, an attempt to reflect the perceptual characteristics of the human ear that is sensitive to low frequencies and relatively insensitive to high frequencies, i.e., the different perceptual sensitivities relative to different perceptual frequencies in coding of the LSF parameters is described in "The MEL LSF VECTOR QUANTIZATION SPEECH CODING METHOD" by SEKI at al, TECHNICAL REPORT OF IEICE, SP 86-14, June, 1986 (literature 1). In this literature, a proposal is made for a method which quantizes the LSF parameters (here synonym for LSF parameters) using the Mel measurement or the log measurement each of which is a type of nonlinear frequency measurement.

However, in the transformation to log measurement proposed in literature 1, the LSF parameters are directly transformed into the form of log10 (F(k)). The present inventors made an attempt to code 10-th-order LSF parameters obtained from a speech signal sampled at 8 kHz with the number of bits of the order of 20 bits. As a result, it has become clear that the distortion of LSF parameters in the low frequency range is unnoticeable, but the distortion of LSF parameters in the high frequency range due to quantization becomes easy to be perceived, and totally the speech quality degrades. Therefore, with mere logarithmic transformation of LSF parameters, it is difficult to reduce the bit rate of the LSF parameters.

As described above, the conventional LSF parameter coding method has problems that, unless the coding distortion of LSF parameters is reduced to a sufficiently low level, the distortion becomes easy to be perceived at frequencies which is perceptually sensitive and the coding bit rate of these parameters cannot be reduced much.

BRIEF SUMMARY OF THE INVENTION

It is an object of the present invention to provide a speech encoding/decoding method which permits the coding distortion to be made difficult to be perceived even if the coding bit rate of LSF parameters is reduced to some degree.

According to the present invention, in a speech encoding method including a process of encoding speech parameters representing the spectral envelope of an input speech signal using LSF parameters, autocorrelation coefficients are obtained first from the input speech signal.

Next, a number N of first LSF parameters F(k) (k=1, 2, . . . , N) is obtained on the basis of the autocorrelation coefficients.

Next, the first LSF parameters are subjected to a transformation defined by $$f(k)=\log C(1+A\times F(k))$$

(A, C=positive constant), thereby obtaining second LSF parameters f(k).

This transformation is a logarithmic transformation with offset. In order to distinguish it from a mere logarithmic transformation in conventional techniques, it is herein referred to as a modified logarithmic transformation. In this case, it follows that the second LSF parameters f(k) are LSF parameters on the modified logarithmic scale. These LSF parameters are referred to as modified logarithmic LSF parameters. The modified logarithmic transformation may be implemented through the use of a table that simulates the modified logarithmic transformation.

Next, the second LSF parameters are quantized to obtain third quantized LSF parameters fq(k) and first codes representing the third LSF parameters. The second LSF parameters are quantized on the modified logarithmic transformation domain. The first codes correspond to coded versions of speech parameters representing the spectral envelope of the input speech signal.

Finally, the third LSF parameters are subjected to an inverse transformation defined by $$Fq(k)=(C^{fq(k)}-1)/A$$

thereby obtaining quantized fourth LSF parameters Fq(k).

In actually using the aforementioned method of encoding speech parameters to encode speech, excitation signal information, such as pitch period information, noise information and gain information, is obtained from the input speech signal and the fourth LSF parameters. Second codes representing the excitation signal information are generated and then combined with the first codes for transmission to the decoder side.

In a speech decoding method of the present invention, in order to decode the speech parameters from the first codes transmitted from the encoder side, the speech parameters in the first codes are first dequantized to decode the third LSF parameters fq(k).

Next, the third LSF parameters thus decoded are subjected to an inverse transformation defined by $$Fq(k)=(C^{fq(k)}-1)/A$$

where k=1, w, . . . , N thereby obtaining the fourth LSF parameters Fq(k).

In actually using the aforementioned method of decoding the speech parameters to decode encoded speech, the excitation signal information is decoded from the second codes. The decoded excitation signal information and the fourth LSF parameter obtained in the above manner are then used to reproduce an output speech signal.

The speech encoding/decoding method of the present invention employs the perceptual property of the human ear that is sensitive to low frequencies but relatively insensitive to high frequencies. Speech can be represented exactly by using the frequency axis on modified logarithmic scale (the frequency resolution is high in the low-frequency range but low in the high-frequency range) that conforms to such perceptual property.

That is, in the present invention, the LSF parameters F(k), which are parameters on the general frequency axis, are subjected to a modified logarithmic transformation using the constant A and the offset value 1. The resulting parameters f(k) are then quantized, which allows speech to be encoded while controlling the generation of noise in each frequency band to conform to the perceptual property of the human ear. It is desirable that the constant A be set to such a value as weight is given to the LSF parameters in the low-frequency range, but the LSF parameters in the high-frequency range are not taken too lightly. To be specific, the constant A is preferably set to meet $0.5<A<0.96$.

According to the other speech encoding method of the present invention, weights used in quantizing the second LSF parameters are obtained on the basis of distance between adjacent second LSF parameters (distance on the modified logarithmic scale transformation domain). Using these weights, the second LSF parameters are quantized on the logarithmic scale transformation domain, thereby generating the third LSF parameters and the first codes. This allows the LSF parameters to be quantized in such a way as to attach importance to peak positions of the spectral envelope on the frequency axis subjected to modified logarithmic transformation. Thus, the encoding of LSF parameters can be implemented in such a way as to make subjective distortion more difficult to be perceived.

Thus, according to the present invention, a speech encoding/decoding method can be implemented which renders the encoding distortion difficult to be perceived even with some reduction in the LSF parameter encoding bit rate.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
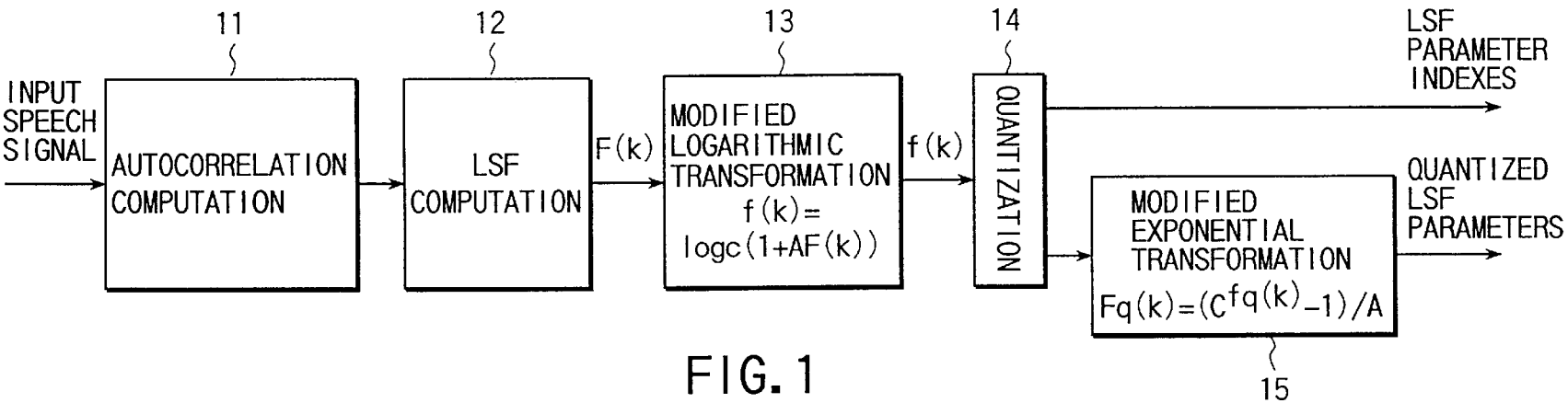
FIG. 1 is a block diagram of an LSF encoder unit in a speech encoding system according to a first embodiment of the present invention.

Referring now to FIG. 1, there is shown, in block diagram form, an LSF encoder unit which, serving as a key component of a speech encoding system according to a first embodiment of the present invention, encodes LSF parameters that represent the spectral envelope of a speech signal. The encoder unit comprises an autocorrelation computation section 11, an LSF computation section 12, a modified logarithmic transformation section 13, a quantizer section 14, and a modified exponential transformation unit 15.

Hereinafter, each component will be described in detail. First, the autocorrelation computation section 11 computes an autocorrelation coefficient for each frame of an input speech signal and provides the resulting autocorrelation coefficient to the LSF computation section 12. The LSF computation section computes LSF parameters F(k) (k=1, 2, . . . , N) from the autocorrelation coefficient in accordance with a known method (described in a book, e.g., Sadaoki Furui "Digital speech processing", Tokai University Press, pp. 60–64 and pp. 89–92). N is the order of the LSF parameters.

The modified logarithmic transformation section 13 transforms the LSF parameters F(k) or their corresponding frequencies into LSF parameters f(k) on the modified logarithmic scale (which are referred to as modified logarithmic LSF parameters) in accordance with the following process of transformation (referred to as modified logarithmic transformation with offset).

$$F(k)=\log C(1+A\times F(k))(k=1, 2, \ldots, N) \quad (1)$$

where A and C are each a positive constant and C is the base of logarithm.

With speech encoding at low bit rates, when the sampling frequency is 8 kHz, a typical value of N is 10. The value of the constant A suitable for use in the above-mentioned modified logarithmic transformation with offset is $0.5<A<0.96$. In particular, when A is set to a value close to 0.96, encoding can be implemented with little perceptual distortion. When A=1, the process is close to the conventional method disclosed in literature 1 and hence quantization distortion in the high-frequency range becomes easy to be perceived as a result of attaching excessive weight to the low-frequency range. When A<0.5, the effect of attaching importance to the low-frequency range is almost lost. In that case, quantization distortion in the low-frequency range becomes easy to be perceived.

The quantization section 14 quantizes the modified logarithmic LSF parameters f(k) from the modified logarithm transformation section 13 provides quantized modified logarithmic LSF parameters fq(k) and their codes. The quantization method used in the quantization section 14 may be either scalar quantization or vector quantization. In addition, the quantization section may combine scalar quantization or vector quantization with predictive coding. For computation of quantization distortion, the commonly used mean square error or mean absolute difference criterion can be used. For example, assume that a modified logarithmic LSF parameter is quantized into M bits by N-dimensional vector quantization. Then, using the mean square error distortion, the distortion can be defined as follows:

$$Ei = \sum_{k=1}^{N} (f(k) - fq(k)(i))^2 \quad (i = 0, 1, \ldots, 2^M - 1) \tag{2}$$

where i are M-bit codes representing quantization candidates for modified logarithmic LSF parameters f(k) and $fq(k)^{(i)}$ represent representative vectors stored in a codebook for each LSF parameter f(k). A search is made through the codes i for a code representing a representative vector for which the distortion is minimum and that code is outputted as the code I for an input LSF parameter f(k). The representative vector that corresponds to the code I is outputted from the quantization section 14 as the quantized modified logarithmic LSF parameter fq(k).

The modified exponential transformation section 15 performs on the quantized modified logarithmic LSF parameters fq(k) a transformation that is the inverse of that in the modified logarithmic transformation section 13, thereby transforming the quantized modified logarithmic LSF parameters fq(k) into LSF parameters F(k) on the general scale. In the case of modified logarithmic transformation defined in equation (1), it is required to perform an inverse transformation defined by $$Fq(k)=(C^{fq(k)}-1)/A(k=1, 2, \ldots, N) \tag{3}$$

It is of importance here to perform the inverse transformation so that the scaled parameters are restored to the original ones. It therefore does not matter to the present invention how the transformation and the inverse transformation are implemented. For example, the modified logarithmic transformation and the modified exponential transformation may be implemented through the use of tables.

Thus, the embodiment is characterized by transforming the LSF parameters on the frequency axis to a frequency scale that is closer to the perceptual property of the human ear using the modified logarithmic frequency scale based on equation (1) and then quantizing them on that transformation domain. By so doing, even with degradations in the LSF parameters due to quantization, the degree of degradation of LSF parameters in low-frequency range becomes very low. With LSF parameters in high-frequency range, codes are selected so that the degradation becomes relatively large in a range in which perceptual distortion is difficult to be perceived.

According to the present invention, therefore, subjective distortion is reduced by representing the spectral envelope of speech using quantized LSF parameters. When actually applied to speech encoding, the present invention can improve speech quality even under the same coding bit rate.

Figure 2:
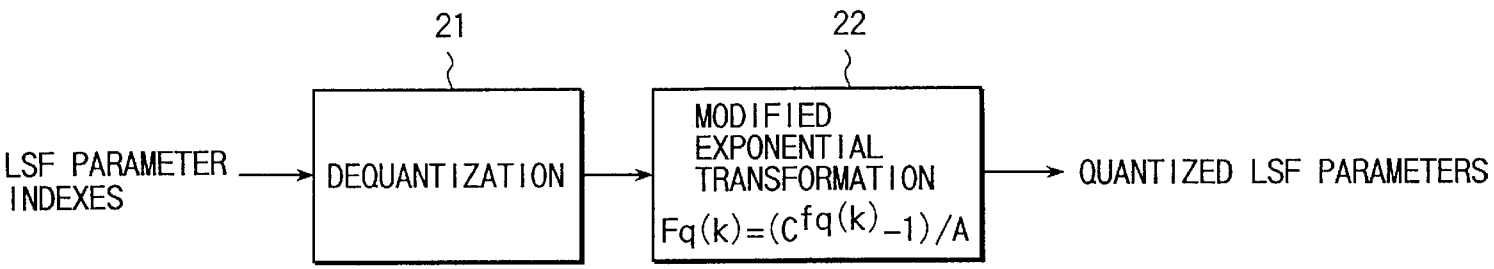
FIG. 2 is a block diagram of an LSF decoder unit in the speech encoding system according to the first embodiment of the present invention.

FIG. 2 shows an arrangement of an LSF decoder unit that is a key component of the speech decoding system of the present embodiment. The decoder unit, which is responsive to an LSF parameter code to produce the corresponding quantized LSF parameter, comprises a dequantizer section 21 and a modified exponential transformation section 22.

The dequantizer 21 receives an LSF parameter code from the encoder side and outputs the corresponding quantized modified logarithmic LSF parameter fq(k).

The modified exponential transformation section 22, which is identical in function to the modified exponential transformation section 15, transforms the quantized modified logarithmic LSF parameter fq(k) into an LSF parameter Fq(k) on the general frequency scale.

Next, the procedure of encoding the LSF parameters according to the present embodiment will be described with reference to a flowchart shown in FIG. 3.

First, autocorrelation coefficients are obtained from an input speech signal (step S1).

Next, LSF parameters F(k) are obtained based on the autocorrelation coefficients (step S2).

Next, the LSF parameters F(k) are transformed into LSF parameters f(k) on the modified logarithmic scale using equation (1) (step S3).

Next, in step S4, the LSF parameters f(k) are quantized on the modified logarithmic scale transformation domain. A search is then made through M-bit codes i representing quantization candidates for the modified logarithmic LSF parameters for a code I for an LSF parameter for which distortion is minimized on the transformation domain. The quantized LSF parameter fq(k) on the modified logarithmic scale that corresponds to that code I is outputted.

Next, the quantized modified logarithmic LSF parameter fq(k) is subjected to a modified exponential transformation in accordance with equation (3), providing the quantized LSF parameter Fq(k) (step S5).

Finally, the LSF parameter code I searched in step S4 and the quantized LSF parameter Fq(k) corresponding to that code are outputted (step S6).

The above sequence of processes is carried out in units of a frame of the input speech signal until it is decided in step S7 that the input speech signal has terminated (i.e., no frame is left). In this manner, spectral envelope information can be encoded.

Next, the procedure of decoding the LSF parameters according to the present embodiment will be described with reference to a flowchart shown in FIG. 4.

First, the LSF parameters code I from the encoder are subjected to an inverse quantization (dequantization), so that the modified logarithmic LSF parameters fq(k) are generated (step S11). The LSF parameters fq(k) are subjected to an inverse transformation in accordance with the above equation (3) and the fourth LSF parameters represented by Fq(k) are then reproduced (step S12).

Figure 5:
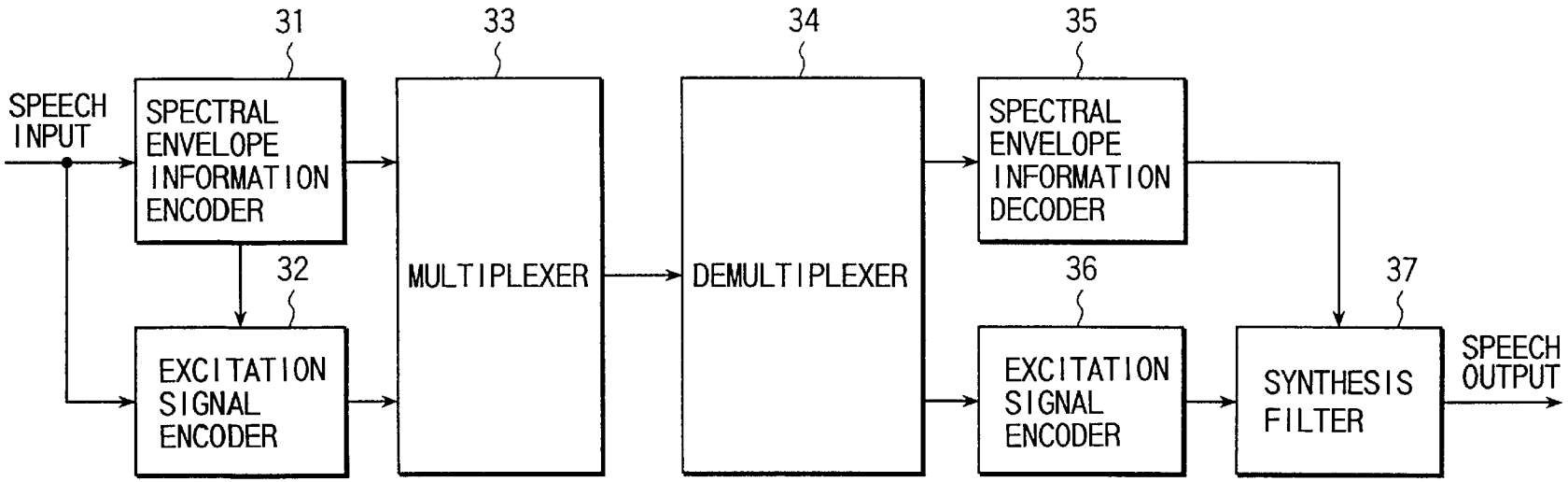
FIG. 5 is a block diagram of a speech; encoding/decoding system according to the first embodiment of the present invention.

Next, reference will be made to FIG. 5 to describe an arrangement of the entire speech encoding/decoding system representing a speech signal in the form of coded spectral envelope information and coded excitation signal information. As such a system, there is a speech coding/decoding system based on CELP.

The encoding side will be described first.

A spectral envelope information encoder 31 analyzes an input speech signal on a frame-by-frame basis to obtain LSF parameters and encode them. In that case, the LSF parameters representing spectral envelope information are encoded using the LSF parameter encoding method of the present invention as described in connection with FIG. 1.

An excitation signal encoder 32 obtains speech signal information including pitch period information, noise information, and gain information other than the speech spectral information by means of CELP by way of example.

The coded LSF parameters (spectral envelope information) from the spectral envelope information encoder 31 and the coded excitation signal information from the excitation signal encoder 32 are multiplexed together in a multiplexer 33 and then transmitted to the decoding side.

Next, the decoding side will be described.

A demultiplexer 34 demultiplexes the multiplexed coded information from the encoding side into the coded LSF parameters and the coded excitation information. A spectral envelope information decoder 35 decodes the coded LSF parameters to reproduce the LSF parameters, which, in turn, are transformed into LPC coefficients. The coded excitation information is decoded in an excitation signal decoder 36, so that the excitation signal is reconstructed.

A synthesis filter 37, which has its transfer characteristic set by the LPC coefficients from the spectral envelope information decoder 35, receives as an input signal the reconstructed excitation signal from the excitation signal decoder 36. In the synthesis filter, the spectral envelope information is imparted to the input excitation signal, allowing an output speech signal to be reconstructed. At this point, in order to improve subjective speech quality, it is possible to perform such postfiltering as enhances the characteristics of the synthesis filter 37 as its final stage.

Figure 6:
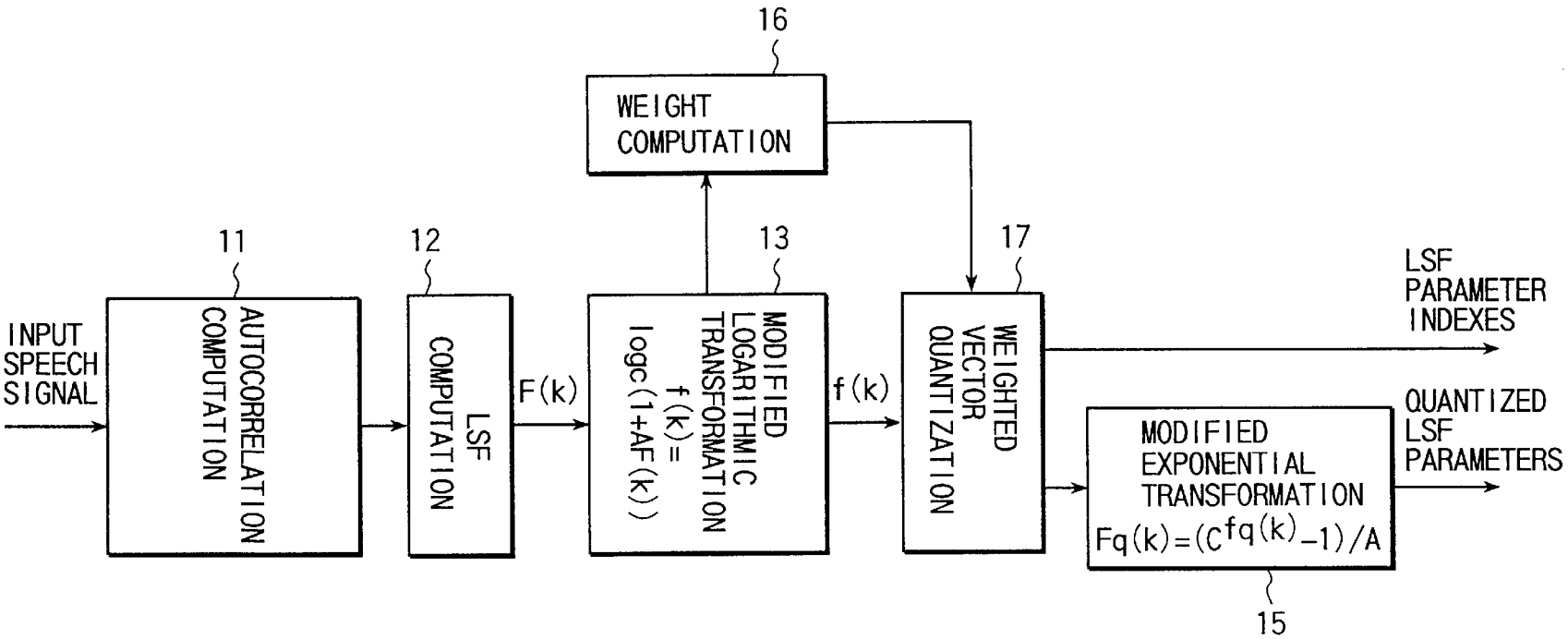
FIG. 6 is a block diagram of an LSF encoder unit in a speech encoding system according to a second embodiment of the present invention.

FIG. 6 shows an arrangement of an LSF encoder which is a key component of a speech encoding system according to a second embodiment of the present invention. In this figure, like reference numerals are used to denote corresponding parts to those in FIG. 1. In this embodiment, a weight computation section 16 is added and the quantizer 14 in FIG. 1 is replaced with a weighted vector quantizer section 17. The weighted distortion can be defined as follows:

$$Ei = \sum_{k=1}^{N} W(k)(f(k) - fq(k)(i))^2$$

In FIG. 6, the processes in the autocorrelation computation section 11, the LSF computation section 12, the modified logarithmic transformation section 13 the modified exponential transformation section 15 remain basically unchanged from those in the first embodiment. That is, the autocorrelation computation section 11 computes autocorrelation coefficients for each frame of an input speech signal, and the LSF computation section 12 computes LSF parameters F(k) (k=1, 2, . . . , N) using the autocorrelation coefficients. The modified logarithmic transformation section 13 transforms the LSF parameters F(k) or their corresponding frequencies into modified logarithmic LSF parameters f(k) in accordance with the modified logarithmic transformation with offset defined in equation (1).

The weight computation section 16 computes weights W(k) used in quantizing the modified logarithmic LSF parameters f(k) in the weighted vector quantizer section 17. The weights W(k) depend in magnitude on the distance between f(k) and f(k−1) or f(k+1), or the distances between f(k) and f(k−1) and between f(k) and f(k+1). The smaller the distance, the greater the weight W(k).

Setting the weights W(k) in this manner allows the weighted vector quantizer section 17 to quantize the LSF parameters while giving more weight to LSF parameters that are closer to each other on the frequency axis subjected to the modified logarithmic transformation. That is, LSF parameter encoding is rendered possible that gives weight to the positions of peaks of the spectral envelope on the frequency axis subjected to modified logarithmic transformation.

As a result of such weighting quantization, the perceptual distortion is further reduced. The weighted vector quantizer section 17 performs vector quantization using weights W(k) and LSF parameters f(k). At this point, a code for an LSF parameter which yields low distortion under the weighted distortion criterion and a quantized modified logarithmic LSF parameter fq(k) corresponding to that code are outputted from the weighted vector quantizer section 17.

The modified exponential transformation section 15 performs on the quantized modified logarithmic LSF parameter fq(k) transformation that is the inverse of that in the modified logarithmic transformation section 13 to output the LSF parameter Fq(k) on the normal scale.

Figure 7:
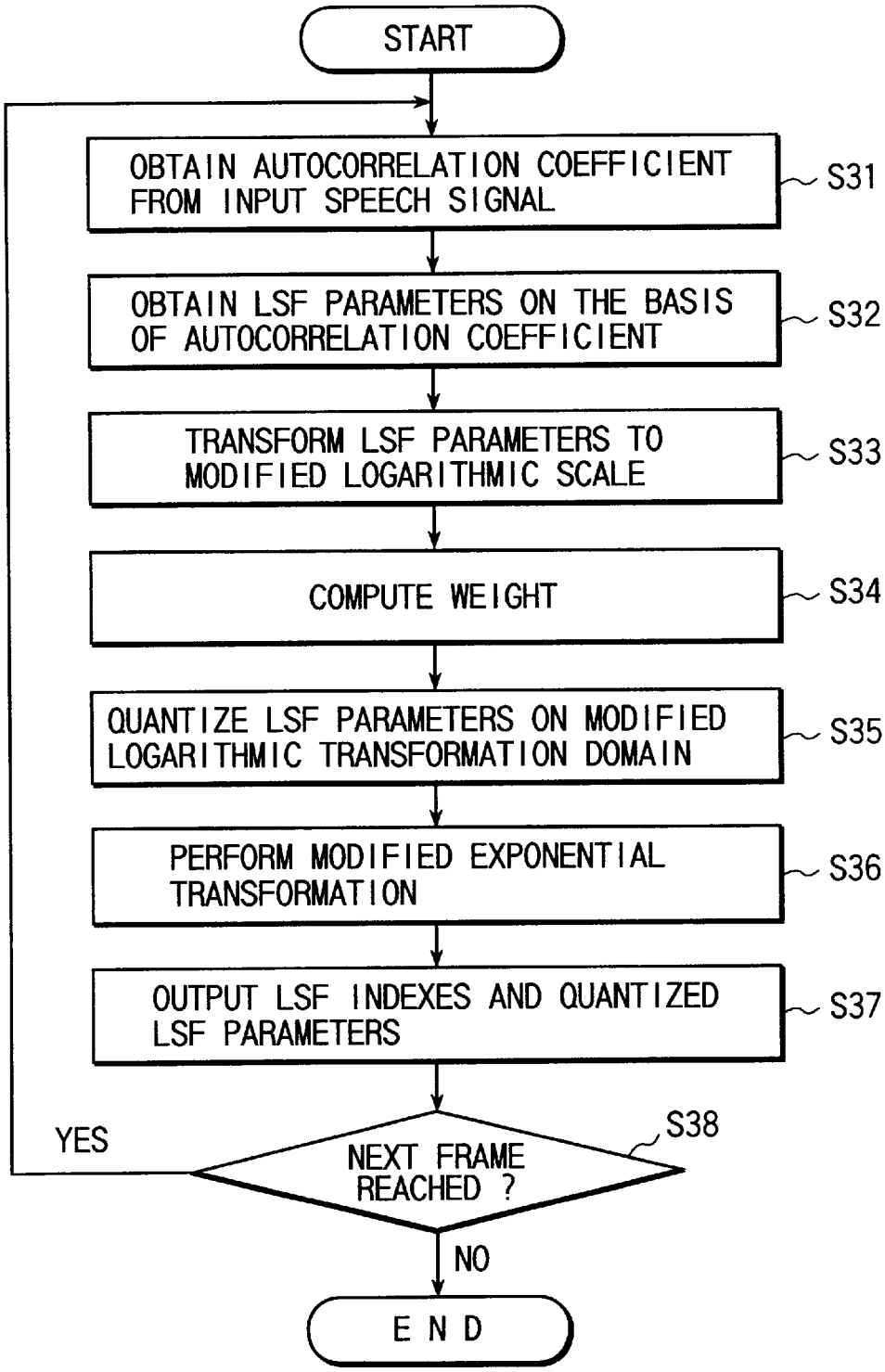
FIG. 7 is a flowchart for the LSF parameter encoding procedure in the first embodiment of the present invention.

Next, reference will be made to a flowchart of FIG. 7 to describe the procedure of encoding the LSF parameters in accordance with the second embodiment.

Figure 3:
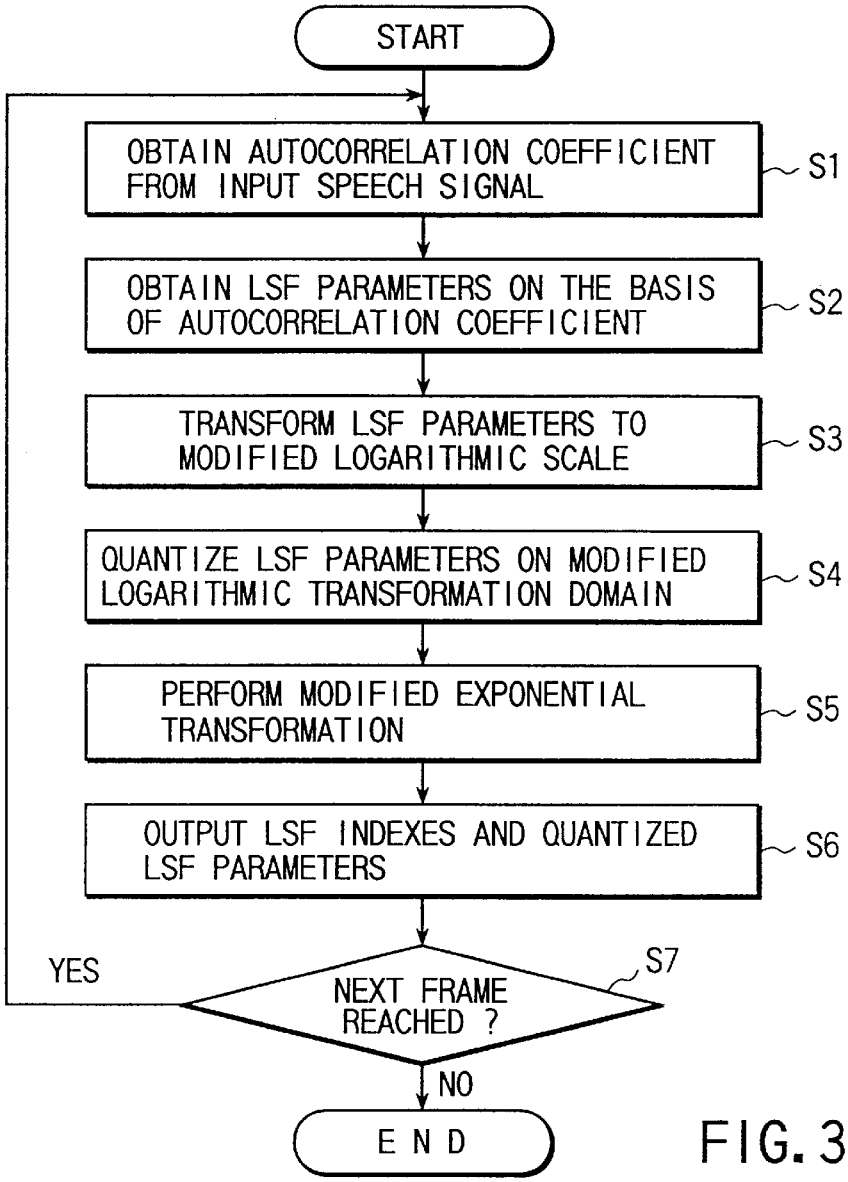
FIG. 3 is a flowchart for the LSF parameter encoding procedure in the first embodiment of the present invention.

The process in steps S31 to S33 corresponds to that in steps S1 to S2 in FIG. 3 and hence description thereof is omitted. In step S34, a weight W(k) is computed. The resulting weight W(k) has a value that depends on the distance between f(k) and f(k−1) or f(+1), or the distances between f(k) and f(k−1) and between f(k) and f(+1). The smaller the distance, the greater the weight becomes.

Using the computed weight W(k), the LSF parameter f(k) is quantized on the modified logarithmic transformation domain. A search is made through M-bit codes i representing quantization candidates for the modified logarithmic LSF parameter for a code representing an LSF parameter for which the distortion is minimized on the transformation domain. The quantized LSF parameter fq(k) on the modified logarithmic scale that corresponds to that code is outputted (step S35).

Next, the quantized modified logarithmic LSF parameter fq(k) is subjected to modified exponential transformation defined in equation (3), thereby obtaining the generally quantized LSF parameter Fq(k) (step S36).

Next, the LSF parameter code searched for in step S35 and the corresponding quantized LSF parameter Fq(k) are outputted (step S37).

The above sequence of processes are carried out on a frame-by-frame basis until it is decided in step S38 that the input speech signal has terminated, providing encoding of spectral envelope information.

Figure 4:
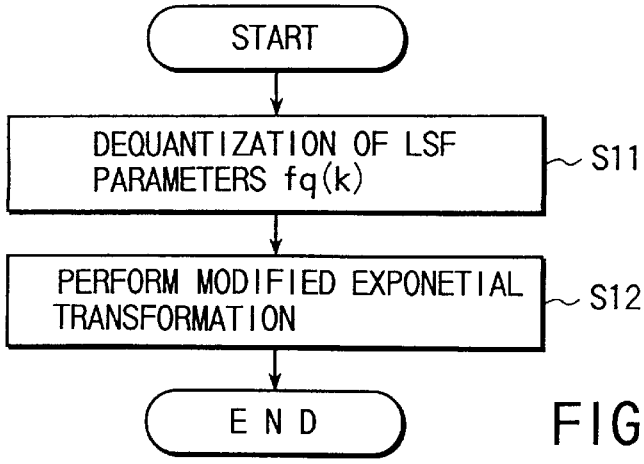
FIG. 4 is a flowchart for the LSF parameter encoding procedure in the first embodiment.

The LSF parameters encoded using weights are decoded in the decoder of FIG. 2 in accordance with similar processing to the flowchart of FIG. 4.

In the invention, the value of the LSF parameters is defined in the unit Hz (hertz) in correspondence with a frequency axis. Therefore, the LSF parameter with respect to the speech signal sampled at 8 kHz takes values in the range of 0 to 4,000Hz. In other words, the LSF parameter takes values in a range of 0 to (fs/2) with respect to the sampling frequency fs. If the LSF parameter is defined in the unit different from Hz, a constant A of a suitable value corresponding to the different unit should be used. For example, if the frequency is normalized and defined by a normalization value (2/fs), the LSF parameter is represented by values in the range of 0 to 1. In such case, a value obtained by multiplying the constant A with (fs/2) is a constant A to be employed. Similarly, when the LSF parameter is represented by values in the range of 0 to $\pi$ (rad), the value obtained by multiplying the constant A with (fs/(2$\pi$)) is a constant A to be employed. In other words, the present invention can be applied to the speech encoding and decoding regardless of the unit of the frequency.

As described so far, the present invention provides a speech encoding/decoding method which can render encoding distortion difficult to be perceived even with some reduction in the LSF parameter encoding bit rate.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A speech encoding method of encoding speech parameters representing the spectral envelope of an input speech signal comprising the steps of:

obtaining an autocorrelation coefficient from the input speech signal;

obtaining first LSF (line spectral frequency) parameters represented by F(k) (k=1, 2, . . . , N; N is the order of the LSF parameters) on the basis of the autocorrelation coefficient;

obtaining second LSF parameters f(k) by performing on the first LSF parameters a transformation defined by $$f(k)=\log C(1+A\times F(k))$$

(A, C=positive constant);

quantizing the second LSF parameters to obtain third quantized LSF parameters fq(k) and first codes representing the third LSF parameters; and obtaining fourth LSF parameters Fq(k) by performing on the third LSF parameters an inverse transformation defined by $$Fq(k)=(C^{fq(k)}-1)/A.$$

2. The speech encoding method according to claim 1, wherein the constant A is in the range of 0.5 to 0.96.

3. The speech encoding method according to claim 1, wherein the constant A is in the neighborhood of 0.9.

4. The speech encoding method according to claim 1, wherein, in the step of quantizing, the second LSF parameters are subjected to either scalar quantization or vector quantization.

5. The speech encoding method according to claim 1, further comprising the step of obtaining excitation signal information from the input speech signal and the fourth LSF parameters and outputting a second code representing the excitation signal information.

6. The speech encoding method according to claim 1, further comprising the step of obtaining excitation signal information from the input speech signal and the fourth LSF parameters and outputting a second code representing the excitation signal information.

7. A speech decoding method comprising the steps of:

decoding the third LSF parameters by inverse quantization of the third LSF parameters based on the first codes obtained by the speech encoding method as defined in claim 1; and obtaining the fourth LSF parameters represented by Fq(k) by performing on the decoded third LSF parameters an inverse transformation defined by $$Fq(k)=(C^{fq(k)}-1)/A.$$

8. The speech decoding method according to claim 7, wherein the constant A is in the range of 0.5 to 0.96.

9. A speech encoding method comprising the steps of:

obtaining autocorrelation coefficients for an input speech signal;

obtaining first LSF parameters represented by F(k) (k=1, 2, . . . , N) on the basis of the autocorrelation coefficients;

obtaining second LSF parameters f(k) by performing on the first LSF parameters a transformation defined by $$f(k)=\log C(1+A\times F(k))$$

(A, C=positive constant);

obtaining weights for the second LSF parameters on the basis of their distance to adjacent second LSF parameters;

quantizing the second LSF parameters using the weights to obtain third LSF parameters represented by fq(k) and first codes representing the third LSF parameters; and obtaining fourth LSF parameters represented by Fq(k) by performing an inverse transformation defined by $$Fq(k)=(C^{fq(k)}-1)/A.$$

10. The speech encoding method according to claim 9, wherein the constant A is in the range of 0.5 to 0.96.

11. The speech encoding method according to claim 10, wherein, in the step of quantizing, the second LSF parameters are subjected to either scalar quantization or vector quantization.

12. A speech decoding method comprising the steps of:

(a) decoding the third LSF parameters represented by fq(k) by inverse quantization thereof on the basis of the first codes obtained the encoding method as defined in claim 7;

(b) obtaining the fourth LSF parameters represented by Fq(k) by performing on the decoded third LSF parameters an inverse transformation defined by $$Fq(k)=(C^{fq(k)}-1)/A$$

(c) decoding the excitation signal information from the second code; and (d) reproducing an output speech signal on the basis of the fourth LSF parameters and the excitation signal information decoded in step (c).

13. The speech decoding method according to claim 12, wherein the constant A is in the range of 0.5 to 0.96.

14. A speech encoding method of encoding speech parameters representing the spectral envelope of an input speech signal comprising the steps of:

obtaining autocorrelation coefficients from the input speech signal;

obtaining first LSF (line spectral frequency) parameters on the basis of the autocorrelation coefficients;

obtaining second LSF parameters f(k) by performing on the first LSF parameters a modified logarithmic transformation with offset;

quantizing the second LSF parameters to obtain third quantized LSF parameters and first codes representing the third LSF parameters; and obtaining fourth LSF parameters by performing on the third LSF parameters an inverse transformation against the modified logarithmic transformation.

15. The speech encoding method according to claim 14, wherein, in the step of quantizing, the second LSF parameters are subjected to either scalar quantization or vector quantization.

16. The speech encoding method according to claim 14, further comprising the step of obtaining excitation signal information from the input speech signal and the fourth LSF parameters and outputting a second code representing the excitation signal information.

* * * * *